United States Patent [19]

Bechtel, Jr.

[11] 4,074,392

[45] Feb. 21, 1978

[54] CARD CLOTHING CLIPPED TOP AND A METHOD OF MANUFACTURING THEREFOR

[75] Inventor: Alfred R. Bechtel, Jr., Portsmouth, R.I.

[73] Assignee: Ashworth Bros., Inc., Fall River, Mass.

[21] Appl. No.: 702,679

[22] Filed: July 6, 1976

[51] Int. Cl.[2] ..... D01G 15/24

[52] U.S. Cl. ..... 19/113; 19/102

[58] Field of Search ..... 19/112, 113, 114, 102; 140/97, 100

[56] References Cited

U.S. PATENT DOCUMENTS 504,572 9/1893 Fawcett et al. ..... 19/113

FOREIGN PATENT DOCUMENTS 1,222,918 1/1960 France ..... 19/113

*Primary Examiner*—Dorsey Newton

*Attorney, Agent, or Firm*—Schuyler, Birch, Swindler, McKie & Beckett

[57] ABSTRACT

A card clothing clipped top comprised of a rigid base with a longitudinal groove extending lengthwise adjacent each side thereof and a pair of clips for attaching the top to a flat in a card clothing machine. Each clip has a curved upper portion which engages one of the grooves in the base of the top and a lower portion adapted to engage the bottom surface of the flat. An intermediate portion of the clip connects the upper and lower portions thereof and is provided with a plurality of inwardly extending tabs for engaging recesses in the bottom surface of the base.

In manufacturing the clipped top, recesses are formed in the bottom surface of the base along the sides thereof. The curved upper portion of each clip is then engaged in one of the grooves and a plurality of tabs may be punched out of the intermediate portion and forced inwardly into engagement with the recesses to firmly secure the clips to the base.

6 Claims, 4 Drawing Figures

CARD CLOTHING CLIPPED TOP AND A METHOD OF MANUFACTURING THEREFOR

BACKGROUND OF THE INVENTION

1. Field of the Invention

This invention relates generally to card clothing tops which are adapted to be fastened to the flats in a card clothing machine, and more specifically, to a card clothing clipped top.

2. Discussion of the Prior Art

Conventional carding machines are known in the textile field for combing and teasing uncarded fibers to form a web. Such a carding machine is shown in applicant's prior U.S. Pat. No. 3,793,677. These conventional carding machines generally comprise a rotating carding cylinder and a plurality of flat bars, commonly called flats, which surround about one-third of the surface of the carding cylinder. The surfaces of both the cylinder and the flats are usually toothed or provided with upstanding wires, pins or needles so that the interaction of the cyclinder and the flats will comb and clean the fibers.

The carding teeth, however, are not generally mounted directly to the flat but are embedded in or otherwise secured to a strip that is known as a card clothing top. The top may be secured to the flat by a variety of methods thereby making the top adaptable to virtually any carding machine. For example, the top may be glued to the flat, or be in the form of a plastic cap which is molded to be fitted over the flat. More typically, however, a clip is used on each side of the card top to attach the top to the flat.

It has been customary in the card clothing industry to have the clips permanently attached to the card tops by the manufacturer before the tops are sent to the mills. When the mill receives the card top from the manufacturer, all that needs to be done is to slip the top over the flat and put it in a bedding machine to bend the bottom ends of the clip around the bottom surface of the flat, thereby securing it.

One example of a prior art clip is that shown in Staubli, U.S. Pat. No. 571,985, which is illustrated in FIG. 1 of the present application. Staubli discloses a card clothing top having a cloth base which carries a number of upstanding pins, and a clip on each side of the cloth base for attaching the card top to the flat. Staubli's clip comprises a top portion forming a horizontal tab which rests on the top surface of the cloth base and a plurality of triangular teeth which are bent out of the side of the clip and forced upwardly into the bottom of the cloth base. Thus, Staubli's clip actually penetrates into the cloth base to securely engage the clip to the card top.

Another prior art type of clip for use with a card top having a cloth base is shown in FIG. 2. In this arrangement, the cloth base carries a plurality of upstanding pins and includes a rectangular frame which extends around the periphery of the base outside of the pins. The clips include a plurality of teeth which are bent downwardly over the rectangular frame and into the top surface of the cloth base. Thus, both the clips of Staubli and those shown in FIG. 2 utilize a penetrating toothed engagement into a soft cloth base so that the clip can be attached to the card top at the factory for shipment to the mill.

However, new types of card clothing tops have been developed of the type shown in the applicant's prior U.S. Pat. No. 3,793,677. Such card tops generally comprise a rigid plastic base having a plurality of rows of metallic teeth extending upwardly therefrom. A problem associated with this type of top that the conventional clips known in the prior art for attaching the card tops to the flats cannot be preassembled to the tops at the factory since the teeth upon which the conventional clips depend for engagement are not able to penetrate into the rigid plastic base of the tops.

It has, therefore, been necessary to send the new plastic backed card tops and the clips, such as those shown in FIG. 6 in the applicant's prior patent, from the factory to the mills in a disassembled condition. These clips must then be applied to both the tops and the flat when they are assembled at the mill. Such an arrangement has many disadvantages since the bedding machines which are used to bend the clips around the flats are not designed to readily handle loose clips. Moreover, attaching the clips both to the flats and to the tops is a difficult and time consuming proposition when the clips are not preassembled to the tops.

SUMMARY OF THE INVENTION

Accordingly, it is an object of the present invention to overcome the above-noted disadvantages of prior art clips by providing a clip which can be preassembled to a card clothing top having a rigid plastic base.

It is a further object of the present invention to provide a clip for a card clothing top which can be attached securely to the top without utilizing a penetrating toothed engagement into the material of the top.

Briefly, the present invention accomplishes the foregoing and other objects by providing a card clothing top having a rigid plastic base which carries a plurality of teeth thereon and two clips on either side of the base. The plastic base has a longitudinal groove running the entire length of the base adjacent each side thereof. The plastic base is constructed of a rigid material which is not susceptible to bending under the normal forces encountered during use or installation of the clip.

Each of the aforementioned clips comprises an upper, inverted U-shaped curved portion which is adapted to fit over the side of the base and down into one of the longitudinal grooves adjacent the teeth. The clip further comprises a lower portion which is adapted to be bent up under the bottom surface of the flat when the card clothing top is subsequently applied to the flat and an intermediate portion integrally joining the top and bottom portions. The intermediate portion is provided with a plurality of tabs at spaced locations thereon. Each of the tabs extends inwardly of the intermediate portion to engage in a recess provided in the bottom surface of the plastic base.

When the top curved portion and the tabs on the intermediate portion have been properly engaged with the top and bottom surfaces of the plastic base, the clips are securely attached to the top and may be shipped from the factory in that condition. Upon arrival at the factory, the tops may then be mounted to the flats in a conventional manner.

BRIEF DESCRIPTION OF THE DRAWINGS

The novel features of the invention are set out with particularity in the appended claims but the invention will be understood more fully and clearly from the following detailed description of a preferred embodiment of the invention as set forth in the accompanying drawings, in which:

DESCRIPTION OF A PREFERRED EMBODIMENT

Figure 1:
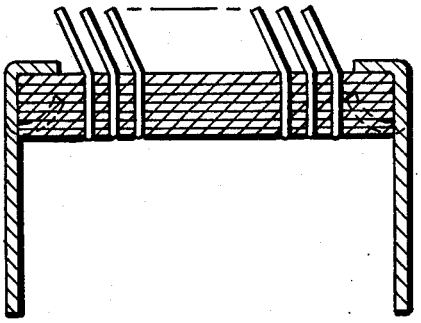
FIG. 1 PRIOR ART
FIG. 1 is a cross-sectional view of a prior art card clothing clipped top.
Figure 2:
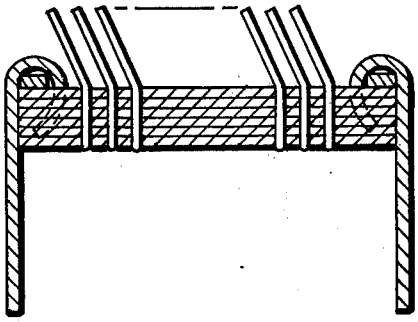
FIG. 2 PRIOR ART
FIG. 2 is a cross-sectional view of another prior art card clothing clipped top.
Figure 3:
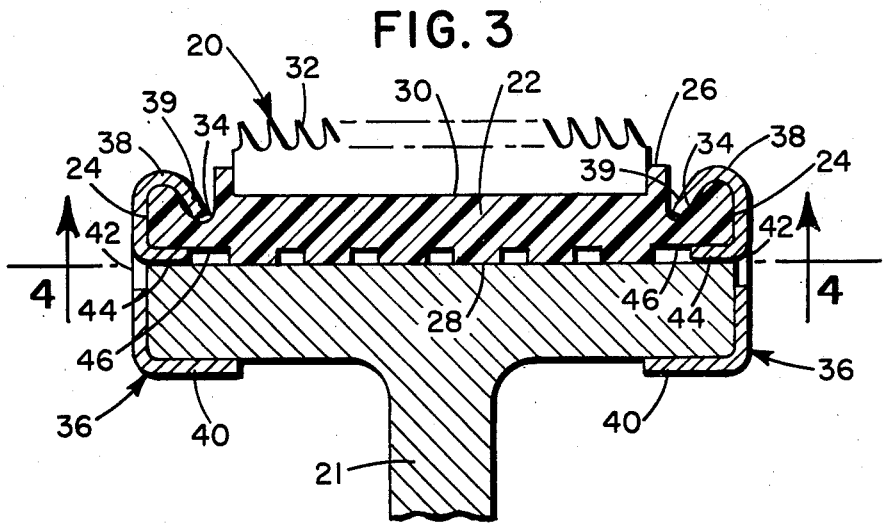
FIG. 3 is a cross-sectional view of the card clothing clipped top according to the present invention attached to a flat.
Figure 4:
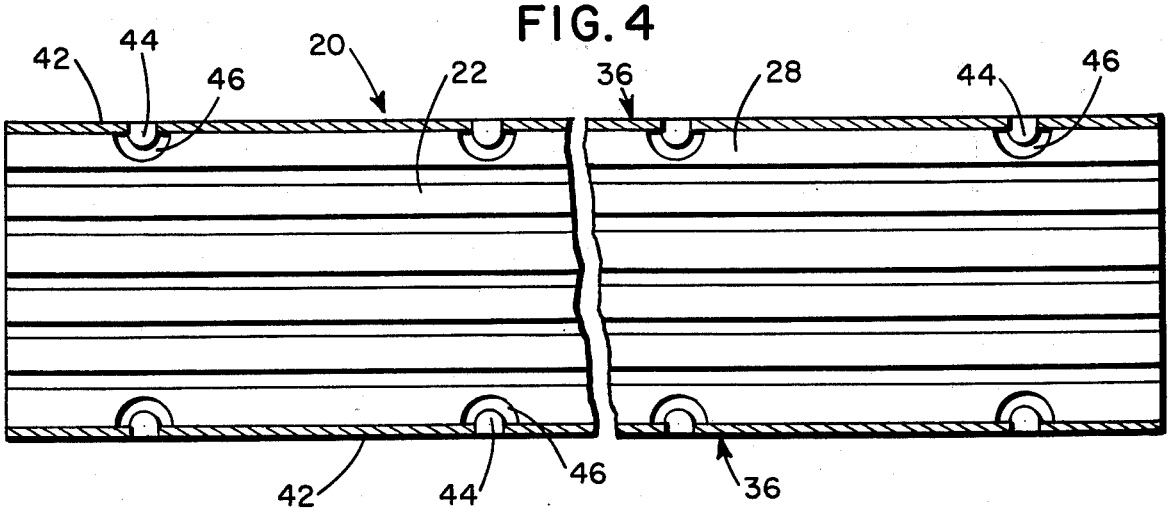
FIG. 4 is a cross-sectional view of the card clothing clipped top according to the present invention taken along line 4—4 in FIG. 3.

Referring now to FIGS. 3 and 4, an elongated card clothing top, illustrated generally at 20 attached to the flat 21 of a card clothing machine, has a rigid plastic base 22. As seen in FIG. 3, the plastic base 22 is generally rectangular in cross-sectional shape having two sides 24 and top and bottom surfaces 26 and 28, respectively. A groove 30 is provided in the top surface 26 of the plastic base 22 over the central portion thereof. A pluraity of metallic teeth 32 are mounted in this groove and extend upwardly therefrom along the entire length of the top 20. A longitudinal groove or notch 34 is provided in the top surface 26 of the plastic base 22 adjacent each side 24 thereof and outwardly of the metallic teeth 32. Each of the grooves 34 runs continuously over the entire length of the plastic base 22.

The card clothing top 20 as described above having a hard plastic base 22 with rows of metallic teeth 32 is generally of the type shown in the applicant's prior patent, U.S. Pat. No. 3,793,667, which is known as the Metallic Lestop. However, it should be understood that any type of teeth may be secured to the base in any configuration as long as they adequately perform the carding function. Furthermore, the base of the top may be formed from any suitable materials or combinations thereof as long as the gase is rigid under the normal forces of use or installation of the top.

The clips of the present invention for securing the card clothing top to the flat are indicated generally at 36 in FIG. 3. Each of these clips 36 comprises a thin, metallic member which connects the card clothing top 20 to the flat 21. Each clip comprises a top or upper inverted U-shaped curved portion 38 which fits over the side 24 and top 26 of the plastic base 22. The end 39 of the upper portion is oriented downwardly to engage in one of the longitudinal grooves 34 adjacent the metallic teeth 32. The clip 36 further comprises a bottom or lower portion 40 which is bent underneath the bottom surface of the flat 21 to secure the card clothing top 20 thereto. An intermediate portion 42 integrally connects the upper 38 and lower 40 portions of the clip 36.

A plurality of tabs 44 are provided at spaced locations on the intermediate portion 42 of the clip 36 to engage the bottom surface 28 of the plastic base 22 of the top 20. These tabs 44 may be punched out or may be separate pieces suitably attached thereto as by welding. As shown in FIG. 3, the tabs 44 extend inwardly at a 90° angle from the intermediate portion 42 to engage the bottom surface 28 of the plastic base 22. Suitable recesses 46 are provided in the bottom surface 28 of the plastic base 22 to receive each of the tabs 44. These recesses 46 are provided so that the tabs 44 do not cause a lump in the plastic base 22 which might interfere with the orientation of the teeth in the groove 30 as well as to insure a secure attachment. The tabs 44 may be U-shaped having a length of approximately one-eighth inch with six tabs being used on each clip 36. However, the number of the tabs utilized, their length and their shape could be varied as needed to securely fasten the clip 36 to the card clothing top 20.

The clips 36 of the present invention may be easily placed over the plastic base 22 of the card clothing top 20 while the top is still at the manufacturer. The top curved portion 38 is first engaged into the corresponding longitudinal groove 34 of the base 22. A plurality of tabs 44 are then punched out of the intermediate portion 42 of the clip 36 and forced into engagement with the bottom 28 of the plastic base 22 in the recesses 46 thereof. The clips 36 are thus securely fastened to the card clothing top 20 which then may be sent to the mills.

When the card clothing tops 20 arrive at the mill, they may easily be slipped over the flat 21 where the bottom portions 40 of the clip 36 are bent underneath the bottom surface of the flat 21 in the usual manner by means of a conventional bedding machine. Since the clip 36 of the present invention is not loose in the bedding machine but is firmly attached to the top 20, the bedding machine encounters no unusual problems in attaching the top 20 to the flat 21. The engagement of the plastic base 22 between the top curved portion 38 and the tabs 44 is sufficient to resist disengaging the plastic base 22 from the clip 36 under the bending forces normally used in attaching the bottom portion of the clip 36 to the flat 21. Thus, the present invention comprises an improved clip for use in attaching card clothing tops having a rigid plastic base to the flat of a card clothing machine.

Although the present invention has been illustrated in terms of a preferred embodiment, numerous modifications may be made without departing from the spirit and scope of the invention. The scope of the invention is to be limited only by the appended claims.

I claim:

1. A card clothing clipped top adapted to be attached to a flat comprising: a substantially rigid base having top and bottom surfaces, a longitudinal groove in said top surface adjacent each side thereof, a plurality of carding teeth mounted on said base and extending upwardly therefrom, a pair of clips for attaching said top to the flat, one of said clips being located on one side of the flat and the other of said clips being located on the other side of the flat, each of said clips having an upper portion engaged in a corresponding one of said grooves without penetrating into said base, a lower portion adapted to be engaged with the bottom surface of the flat and an intermediate portion connecting said upper and lower portions, and a plurality of tabs provided on said intermediate portion extending inwardly therefrom to engage said bottom surface of said base without penetrating into said base to hold each of said clips thereon by a coaction between said upper portion and said tabs.

2. A card clothing top as set forth in claim 1, further comprising a plurality of recesses provided on said bottom surface of said base, each of said tabs engaging said bottom surface in one of said recesses.

3. A card clothing top as set forth in claim 1 wherein said base is constructed of a rigid plastic material.

4. A card clothing upper as set forth in claim 1 wherein said top portion is curved having a free end, said free end being oriented downwardly and engaging in said groove.

5. A method of attaching clips to a card clothing top having a rigid base with longitudinal grooves in the upper surface thereof along each side comprising forming a plurality of recesses on the bottom surface of said top along each side thereof, engaging an upper portion of each said clip in one of said grooves, and forming a plurality of inwardly extending tabs in each said clip and engaging each of said tabs in one of said recesses.

6. A method as set in claim 5 wherein said forming step comprises punching said tabs out of said clip.

* * * * *

UNITED STATES PATENT AND TRADEMARK OFFICE

CERTIFICATE OF CORRECTION

PATENT NO. : 4,074,392

DATED : February 21, 1978

INVENTOR(S) : Alfred R. Bechtel, Jr.

It is certified that error appears in the above-identified patent and that said Letters Patent are hereby corrected as shown below:

In claim 4 at Column 4, line 63, change "upper" to --top--; in line 64, change "top" to --upper--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*